United States Patent [19]

Usher

[11] Patent Number: 4,513,596

[45] Date of Patent: Apr. 30, 1985

[54] APPARATUS AND METHOD FOR FORMING SEAMED TUBE

[75] Inventor: George R. Usher, Brantford, Canada

[73] Assignee: Eagle Precision Tool Ltd., Canada

[21] Appl. No.: 462,868

[22] Filed: Feb. 1, 1983

Related U.S. Application Data

[63] Continuation of Ser. No. 318,789, Nov. 6, 1981, abandoned, which is a continuation of Ser. No. 90,174, Jan. 11, 1979, abandoned.

[30] Foreign Application Priority Data

Oct. 9, 1979 [CA] Canada ..... 337214

[51] Int. Cl.[3] ..... B21D 39/02; B21D 51/28; B21D 5/01

[52] U.S. Cl. ..... 72/51; 72/206; 72/213

[58] Field of Search ..... 72/51, 206, 210, 212, 72/213, 215, 216, 246, 368, 369, 370, 383; 413/72, 73, 75

[56] References Cited

U.S. PATENT DOCUMENTS

| | | | |
|---|---|---|---|
| 1,200,190 | 10/1916 | Hahnemann | 413/73 |
| 4,141,235 | 2/1979 | Ishihara | 72/213 |

FOREIGN PATENT DOCUMENTS

| | | | |
|---|---|---|---|
| 1550629 | 8/1979 | United Kingdom . | |
| 452393 | 7/1975 | U.S.S.R. | 72/215 |

*Primary Examiner*—E. Michael Combs
*Attorney, Agent, or Firm*—Sughrue, Mion, Zinn, Macpeak and Seas

[57] ABSTRACT

The present invention provides an apparatus and method of forming tube, for example, muffler shells by the use of forming sheet over a mandrel by rolling a pair of symmetrical rollers from a point on the mandrel over an arcuate surface thereof to form the sheet thereof, the rolling being performed by roller means which are elongated to extend from the length of the mandrel and which are biased one towards the other with sufficient force to form the sheet as they are rolled over the surface of the mandrel.

2 Claims, 9 Drawing Figures

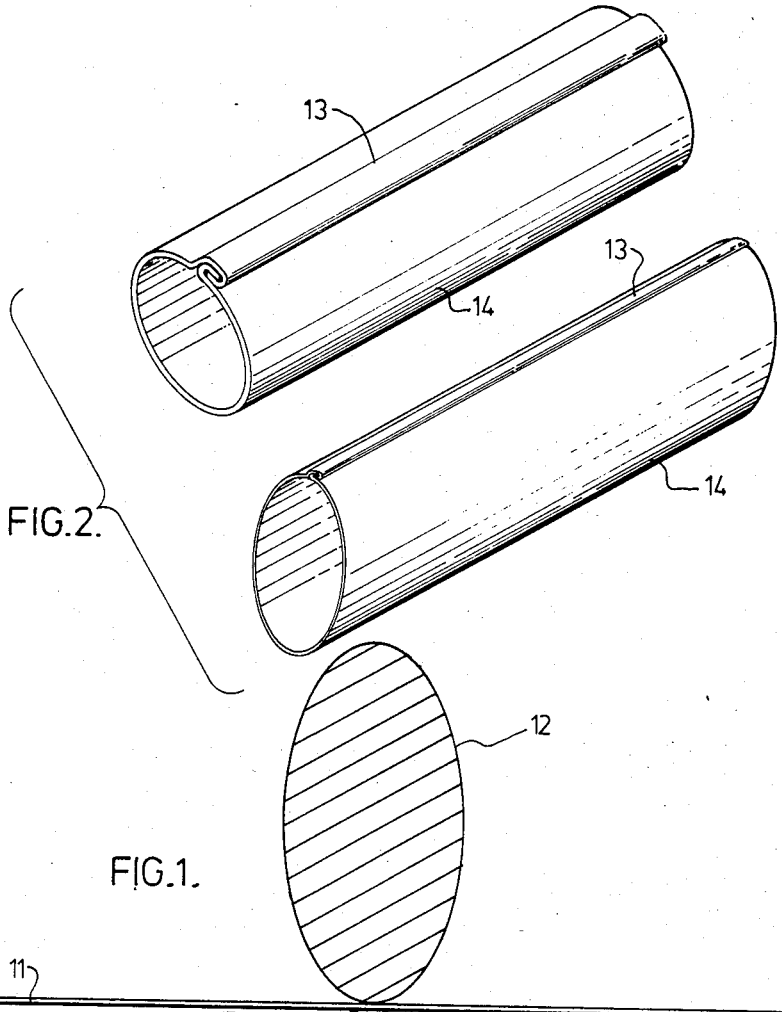
FIG.2.
FIG.1.
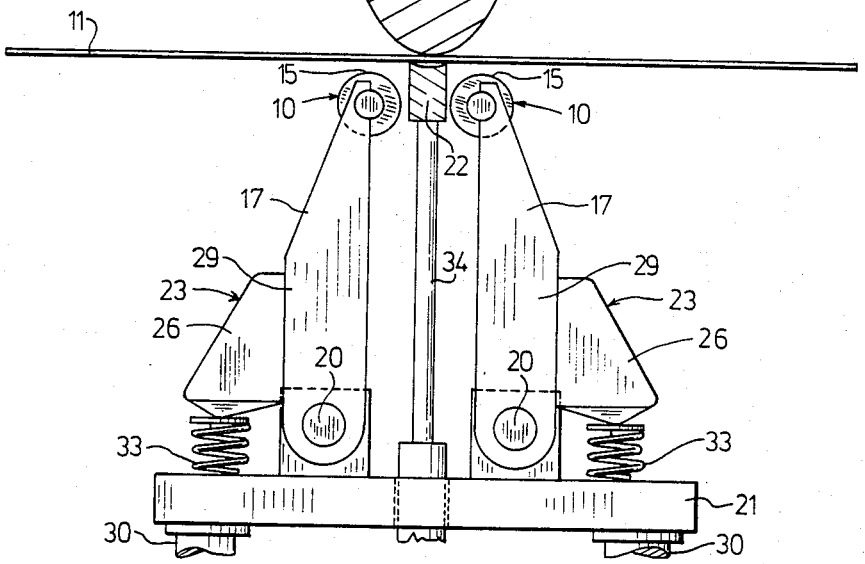

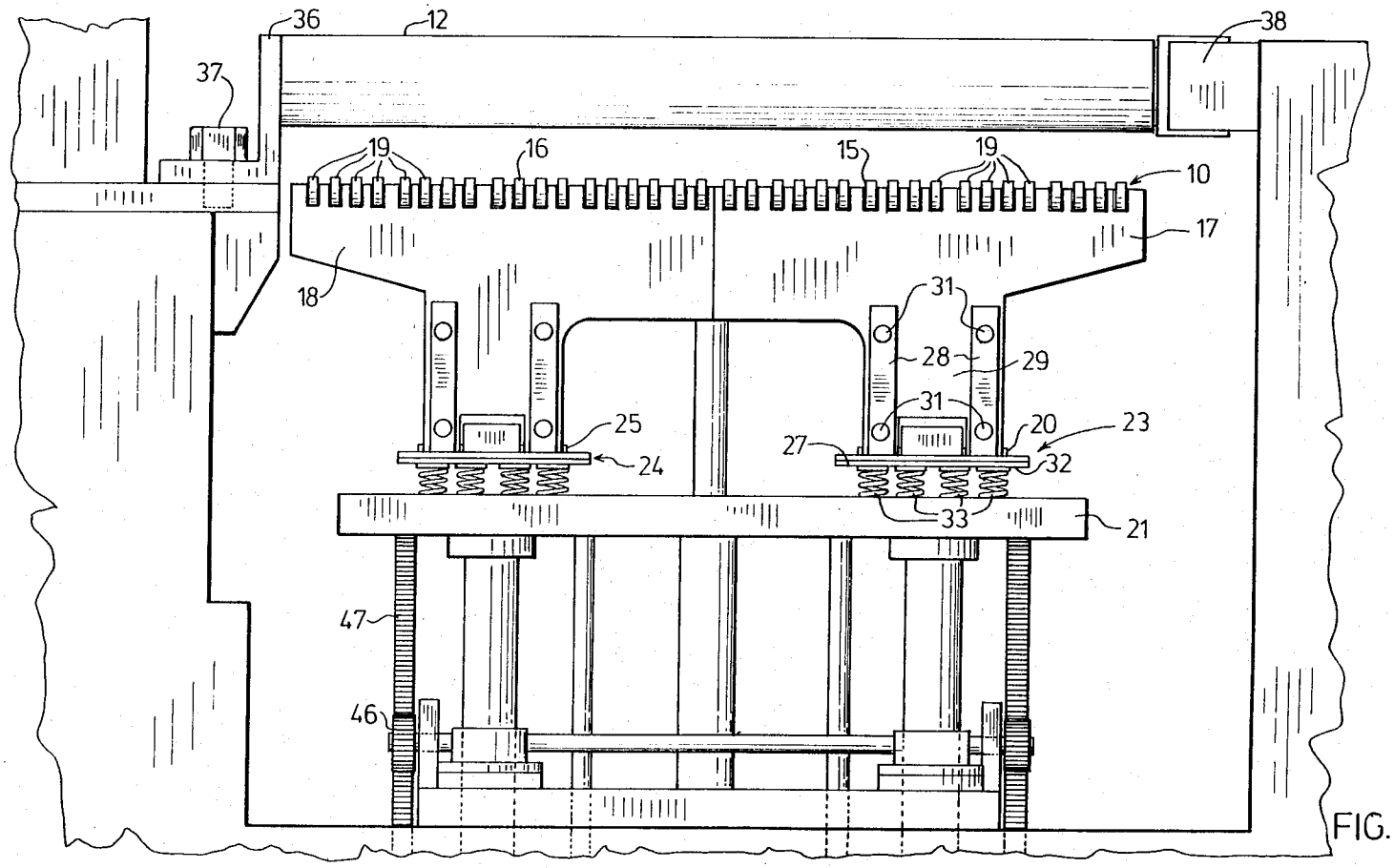
FIG.

APPARATUS AND METHOD FOR FORMING SEAMED TUBE

This is a continuation of application Ser. No. 318,789, filed Nov. 6, 1981 now abandoned which is a continuation of application Ser. No. 90,174 filed Nov. 1, 1979, abandoned.

This invention relates to apparatus and a method for forming seamed tube.

BACKGROUND OF THE INVENTION

Machines for making seamed tubes are used in making shells for mufflers for motor vehicles.

The muffler manufacturing industry demands a high degree of productivity from this equipment both to meet the demand and the competitive pricing of the finished product. In addition to this however the industry, especially the replacement parts industry, is faced with a very large variety of sizes and shapes of mufflers which results in considerable non-productive cost in time and money to constantly change the tooling over from the production of one size or shape to another.

The shell of a muffler is usually made from one or more sheets of relatively thin sheet steel, stainless or carbon, by a process of forming the sheet around a fixed mandrel by means of a moving form die which conforms in shape to the lower half of the muffler and a moving carriage carrying forming rolls and other tooling which completes the wrap around and forms a mechanical lockseam.

The moving form die has had to be made separately for each form of mandrel for each of the various cross-sectional shapes of mufflers required. Moreover, even when tubes of the same cross-sectional shape are required, it is sometimes the case that the thickness of the material from which they are formed is different. Ideally different dies would be used for different thicknesses of material for tubes of the same shape but usually a die suitable for the greatest thickness is used, thus leading to some inaccuracy.

The action between such dies and the mandrel is a clamping squeezing action which can result in creases in the formed metal.

It is an object of the present invention to obviate the disadvantage of known systems.

SUMMARY OF THE INVENTION

The present invention provides a system of forming tube in which at least part of the sheet forming is carried out by rolling. Such a system is particularly suitable for use on metal sheet, for example, steel sheet.

The invention provides in a machine for forming seamed tube of arcuate section from sheet material, the combination comprising an elongated mandrel of the desired arcuate section; an elongated support means to support said sheet material adjacent said mandrel with the plane of said sheet tangential to the arc of said mandrel; first forming means comprising a symmetrical pair of elongated roller means whose axes be parallel to the axis of the mandrel; biasing means for said pair of roller means to bias them symmetrically towards said mandrel with sheet forming force; means to move said pair of roller means against the force exerted by said biasing means to pass over at least a portion of the sheet material to form it over at least a portion of the mandrel surface from a first position in which one roller means of the pair is at its nearest point of travel to the other of said roller means and to said support to a second position in which said one roller means has at least reached its furthest point of travel from said other.

This invention also provides in a method for making seamed tube of arcuate section from sheet material, the steps of supporting sheet material on a support adjacent a mandrel having the desired arcuate section with the plane of said sheet tangential to the arc of said mandrel; forming said sheet material over said mandrel by rolling a symmetrical pair of elongated roller means whose axes be parallel to the axis of the mandrel over the sheet against the mandrel from a first position in which one roller means of the pair is at its nearest point of travel to the other of said roller means and to said support to a second position in which said one roller means at least reaches its furthest point of travel from said other, while biasing the roller means symmetrically towards the mandrel with sheet forming force.

DESCRIPTION OF THE DRAWINGS

The features and advantages of the invention will be understood from the following description and drawings in which an embodiment is illustrated by way of example, and in which:

FIG. 1 is a schematic sketch of a vertical partial cross-section through an example of the mandrel, forming rollers and means for operating said rollers of a machine according to the invention, with a sheet to be formed in position ready to be formed.

FIG. 2 is a perspective view of two tubes which can be formed by the invention by using mandrels of different cross-sections.

FIG. 3 is a side view of the apparatus as shown in FIG. 1, the sheet omitted for ease of illustration.

Figure 5:
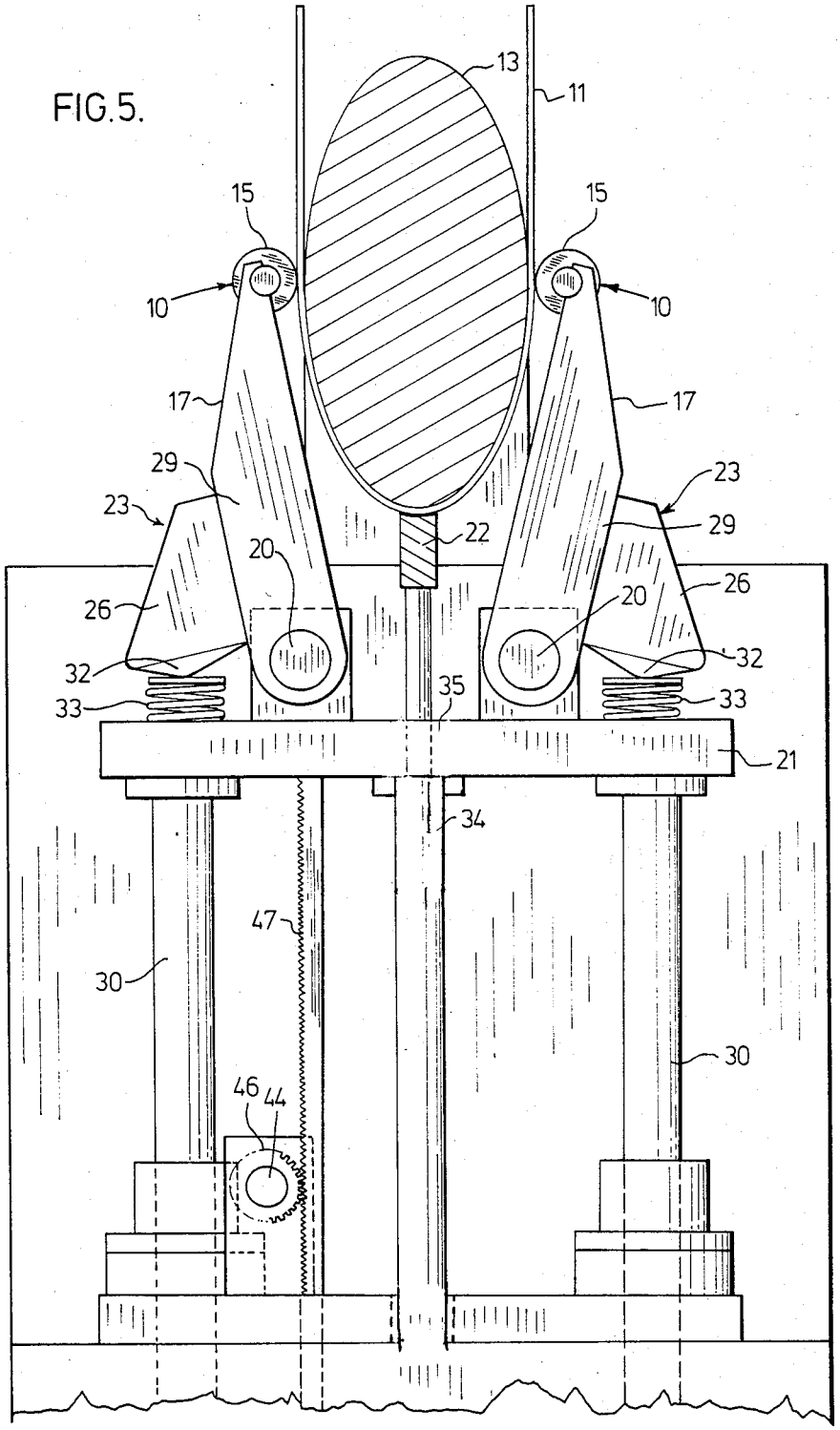
FIG. 5 is a sketch similar to that of FIG. 4 but illustrated at a stage of the first forming operation which may suitably be the end of the first forming operation.
Figure 6:
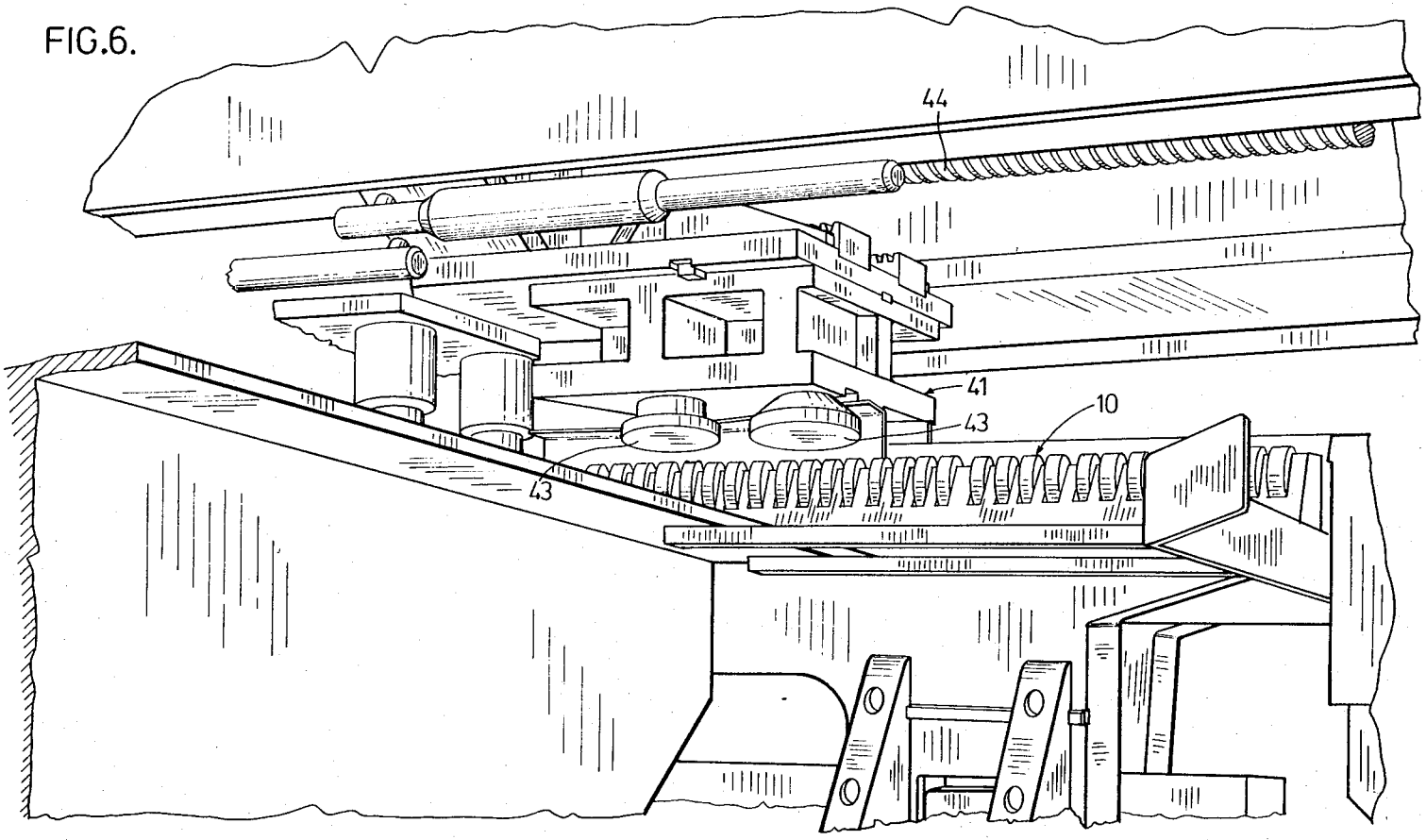
FIGS. 6 and 7 are sketches showing means for finishing and completing the forming operation and seaming the formed tube.
Figure 7:
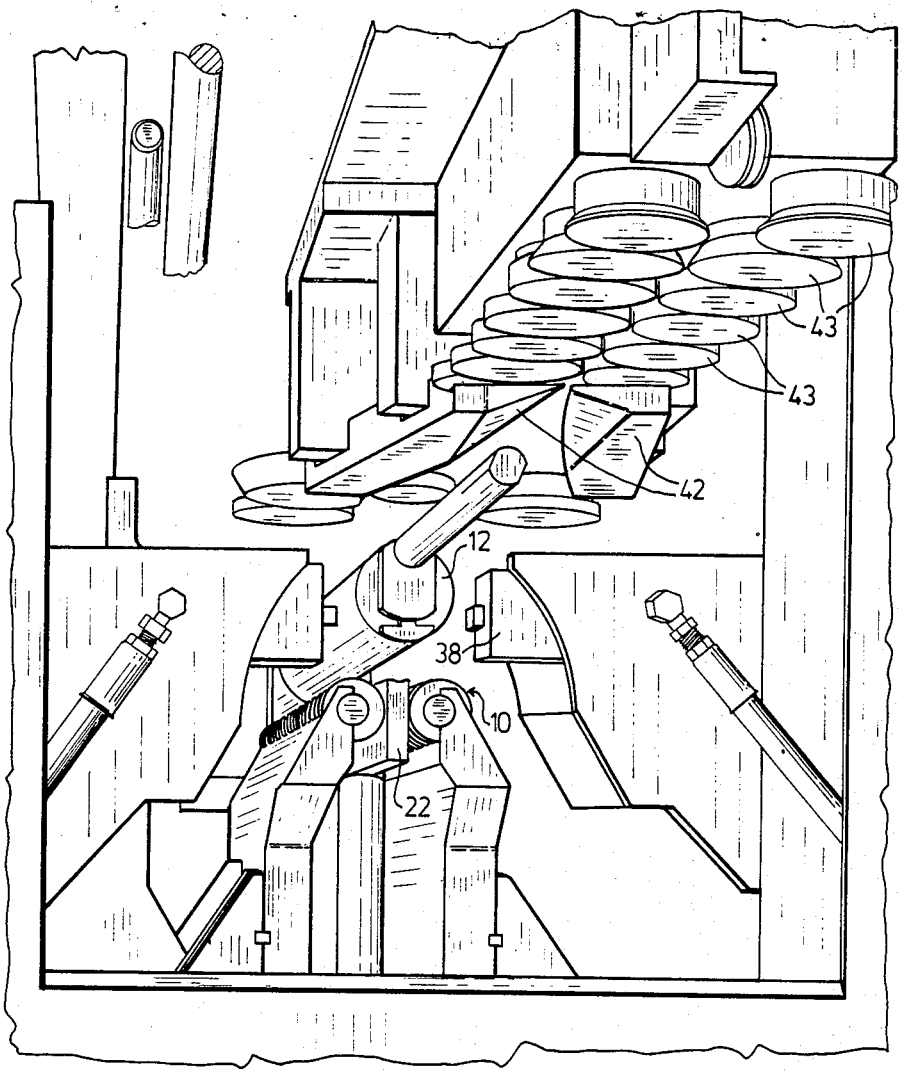
Figure 8:
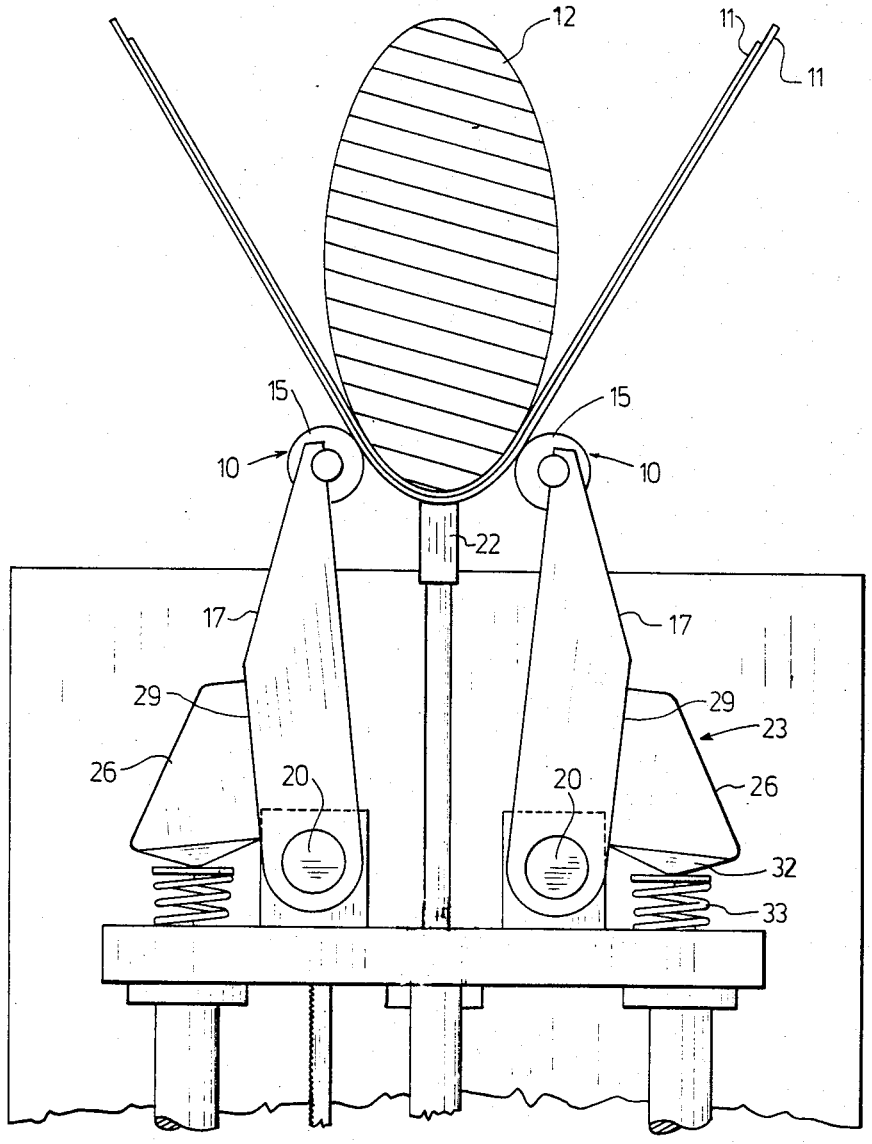
FIG. 8 shows two sheets positioned for forming.
Figure 9:
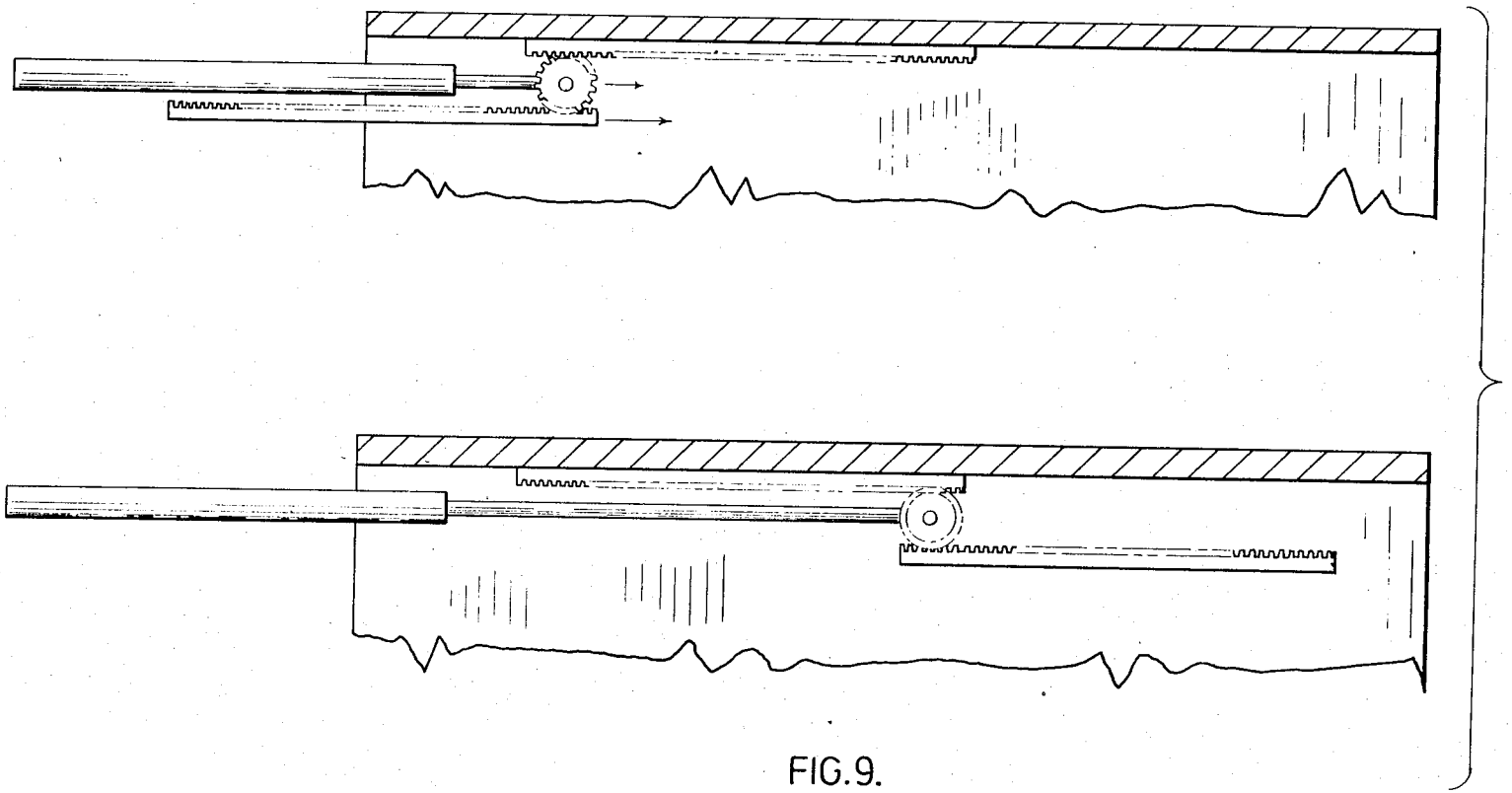
FIG. 9 shows track for the finishing means.

In the drawings is illustrated a pair of roller means 10 mounted to be operable to roll against the surface of a sheet 11 to form it over the surface of a mandrel 12. When the sheet 11 is formed into a U-shape as shown in FIG. 5 or possibly is formed further than that so that the legs of the U are formed further over the mandrel 12 to extend toward one another, a final forming operation is carried out to close the sheet 11 over the mandrel and form a seal 13 at the joint. The resulting tube 14 with the seal 13 can be seen from FIG. 2, the shape of the cross-section of the tube 14 can be selected by appropriate choice of the shape of the mandrel 12. The final forming operation may be carried out by any suitable technique.

Figure 4:
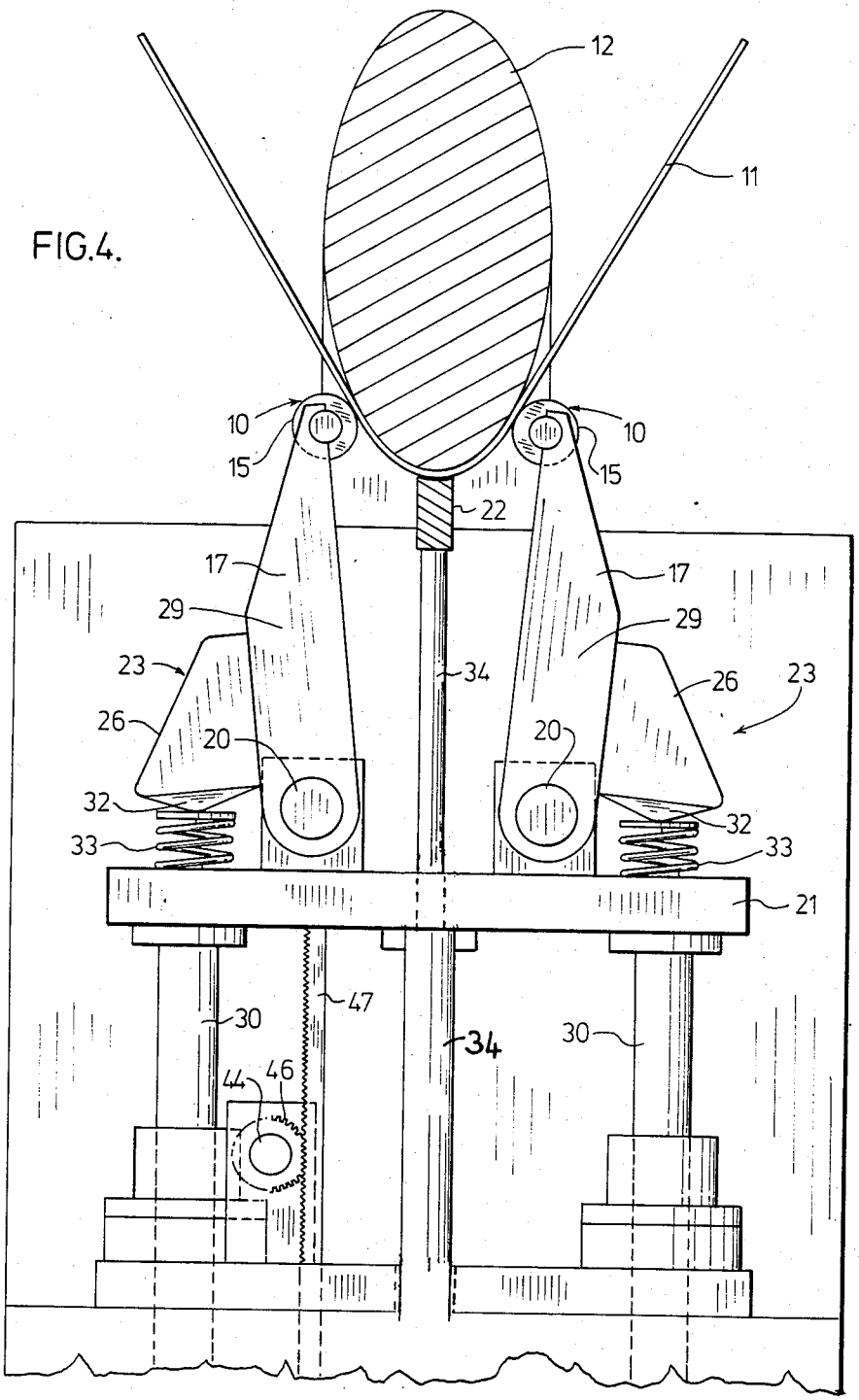
FIG. 4 is a sketch similar to FIG. 1 illustrated at an intermediate stage of the first forming operation.

The pair of roller means 10 supported on corresponding symmetrical pairs of arm means are arranged to move symmetrically over the surface of the mandrel from the position shown in FIG. 1 through the position shown in FIG. 4 to at least the position shown in FIG. 5. Each of the roller means 10 extends along an axis parallel to mandrel 12 and over the length thereof. Since the length of the mandrel may be considerable say, for example, 60 inches, each roller means 10 of the pair are, in the illustrated embodiment subdivided into rollers 15, 16 axially aligned with each other and supported on separate supporting and operating arms 17, 18 respectively. Thus, it can be seen that each roller 10 is a member of a symmetrical pair of rollers 15 and each arm 17 is a member of a symmetrical pair of arms 17. A similar situation exists for rollers 16 and arms 18 and any other lateral rollers provided. Each roller 15, 16 comprises a plurality of rolling elements 19.

The supporting and operating arms 17, 18 for rollers 15, 16 shown laterally adjacent one another in FIG. 3 are each symmetrically arranged with their counterparts for the other roller means 10 comprising rollers 15, 16 and rolling elements 19. The symmetrical arms 17 are pivotally mounted at symmetrical pivots 20 on a platform 21 beneath the mandrel 12. The symmetrical arms 18 are similarly mounted on pivots 25 and any description hereinafter with respect to arms 17 applies similarly to arms 18 and, in fact, to further pairs of symmetrical arms carrying rollers should they be provided. Platform 21 is movably located below the mandrel 12 and pivots 20 are located thereon such that when the machine is in its ready position (FIG. 1) the symmetrical roller means 10 lie close together just below the mandrel 12 on each side of a support 22 for the sheet 11. In this position with the plane of the sheet lying perpendicular to the major axis of the mandrel, it can be seen that until forming actually starts no force is required to be exerted on the sheet 11 between roller means 10 and mandrel 12. This situation is taken into account in the provision of means to provide appropriate forming forces.

To provide appropriate forming forces, two coordinating systems are provided, one of which simply lifts the roller means 10 so that the symmetrical arms 17 pivot outwardly on pivots 20 thus altering the position of roller means 10 with respect to the surface of mandrel 12 and hence the forming force required.

Such a system is easily provided by hydraulic jacks 30 to lift the whole platform 21. To ensure level rise of the platform, a torsion bar 44 is provided extending over the length of the mandrel 12 beneath the platform 21. The bar 44 is rotatably set in fixed bearings 45 near its ends and at its ends carries pinion wheels 46. The wheels 46 mesh with vertical racks 47 depending from the platform 21 and of sufficient length to continue to mesh with pinion wheels 46 even when platform 21 is at its highest point.

The other system is provided by biasing means 23 for the symmetrical arms 17 and hence for the roller 15 which biasing means 23 is automatically self-adjusting to the appropriate forming force according to the position of the roller means 10 with respect to the surface of the mandrel 12. Similar biasing means 24 is provided for symmetrical arms 18 and further similar biasing means is provided for any further pairs of arms.

The biasing means 23 comprise, for each of the symmetrical arms 17 a block 26 fixed to the arm and provided with a vertically directed force between a fixed point or points on the platform 21 and the block. The block as illustrated is of U-shape comprising a web in the form of a plate 27 arranged, in the ready position parallel to the platform 21. The legs 28 of the U-shaped block 26 are blocks in the form of right-angled triangles, one perpendicular side of which extends across plate 27 either fixed thereto or integral therewith. The other perpendicular side of each triangular block is fixed to a vertical portion 29 of each arm 17, for example, by bolts 31. The undersurface of the plate 27 has a thickened portion or rib 32 running its length, which rib 32 bears, in the present embodiment, against compression springs 33. It must, however, be clearly understood that compression springs 33 may easily be replaced by hydraulic or pneumatic or other means to exert expansive force between plate 27 and platform 21. The springs 33 are fixed to the platform 21 at one end and bear vertically at the other end, when the machine is in the ready position, against rib 32 of plate 27. However, in the ready position, as has already been pointed out, no forming force is required and the springs 33 may only be under light compression to hold their position. Arrangements of the springs can be contemplated where no compression is required in this position. It is important that the forces provided for each of the symmetrical arms 17 are similar and that the forces provided by similar biasing means 24 are again similar.

The sheet 11 is held in position in the ready position by elongated support 22 which extends along the length of the mandrel 12 and which is under hydraulic or pneumatic pressure through hydraulic jacks 34 to hold the sheet 11 against mandrel 12 Jacks 34 are fixed to platform 21 and extend through hole 35 in a lower platform.

Mandrel 12 is interchangeable for other mandrels having different arcuate sections. Moreover, although fixed in position for having sheet 11 formed thereon, it is hingably mounted to be swingable in a horizontal plane to lie at, say, right angles to the axes of the roller means 10 for removal and changing. Thus, mandrel 12 is suitably fixed to a hinge member 36 which is pivoted at pivot pin 37. During forming, the mandrel is fixed in position by hydraulically operated support ram 38.

When the sheet has been formed to at least the position shown in FIG. 5, an upper roll carriage 41 is used to carry out the final forming and seaming operation. The carriage 41 comprises forming bars 42 and pairs of seaming rollers 43. Each pair of seaming rollers is provided to make a bend in the sheet 11 at the joint to form a seal 13 of the kind shown in FIG. 2. The carriage 41 travels on a track 44 above and parallel to the mandrel 12. It may be driven by a chain drive connected to the carriage by a connecting rod or preferably by a hydraulically operated piston geared to a rack on a stationary part of the machine.

In operation, a mandrel 12 of chosen arcuate section is selected and fixed in position on hinge member 36 by hydraulic support ram 38. Sheet 11 is fed to lie on support 22, which is then adjusted by hydraulic or pneumatic operation of jacks 34 to hold the sheet securely between the mandrel 12 and support 22. The platform 21 is moved upwardly so that the pair of roller means 10 bear against the underside of sheet 11 thereby to bend it about mandrel 12. As sheet 11 begins to bend about mandrel 12 the pair of roller means 10 are pushed apart to follow the form of the sheet 11 as it bends over the mandrel 12 and the symmetrical arms 17, and the arms 18, open like jaws as they hinge on pivots 20, or 25. This opening of arms 17 and arms 18 moves portion 29 out of the vertical condition and, through triangular blocks 26 and plate 27, bears on springs 33 or hydraulic jacks to increase the compression thereon. The increased compression in springs 33 is transmitted as sheet forming force to sheet 11 through the roller means 10 and as the arms 17 and 18 move even further apart as the platform 21 rises the compression of springs 33 is further increased and the sheet forming force is correspondingly automatically adjusted to a maximum when the sheet has taken the form of a perfect U as shown in FIG. 5. If the arms 17, 18 are formed as angles, the forming process may be taken beyond the formation of a perfect U to continue over the top part of the mandrel. As this happens, the portions 29 of arms 17 will start to return towards the vertical and the forming forces will start to reduce.

Normally however, once the sheet has reached the condition of a perfect U, the final forming is done by means of a single pass of roll carriage 41 which carries forming bars 42. These bars 42 angled towards each other in the trailing direction of the carriage 41 catch and pull together the legs of the U defined by the formed sheet. Carriage 41 also carries seaming rollers which bend sequentially the pulled together edges of sheet 11 to form seams 13 of FIG. 2.

The equipment may be used to form any type of formable sheet, the springs 33 or their mechanical equivalent parts being chosen to have a strength suitable for the forming force necessary to the type of sheet to be formed. The speed of lifting the platform and the hydraulic power needed for lifting same is also a matter of choice according to the formability of the sheet 11.

The invention is particularly suitable for the formation of shells from which mufflers for motor vehicles are formed. Using the apparatus and method of the invention, it is possible to form two sheets at the same time or one immediately on top of the other to a U-shape and thereafter form them to a closed shell with a single composite seam.

It will, of course, be understood that various modifications and changes may occur to those skilled in the art and it is intended that the claims be interpreted to cover such modifications and equivalents.

The embodiments of the invention in which an exclusive property or privilege is claimed are defined as follows:

1. A machine for forming a seamed tube of arcuate section from sheet material comprising an elongated mandrel of desired arcuate cross section having a longitudinal axis, an elongated support means having a longitudinal axis parallel to the longitudinal axis of said mandrel for supporting said sheet material adjacent said mandrel with the plane of said sheet tangential to an arc of said mandrel, first forming means comprising moveable platform means disposed below said support means for movement forward and away from said support means and disposed perpendicular to a plane passing through said longitudinal axes of said mandrel and said support means, a symmetrical pair of elongated roller means pivotally mounted on said platform on opposite sides of said plane, each of said roller means comprising an arm pivoted at one end on said platform means for pivotal movement about an axis parallel to the axis of said mandrel and having a plurality of axially aligned rollers rotatably mounted on the other end of said arm with the rollers being disposed immediately adjacent said plane and biasing means for biasing each of said pair of roller means towards said plane whereby upon movement of said platform means towards said mandrel said sheet will be pressed into engagement with said mandrel only by said rollers of each roller means as said rollers move upwardly from a point immediately adjacent said plane to at least a point adjacent a widest portion of said mandrel and second forming means operable to complete the forming of said sheet material around said mandrel by bringing opposed side edges of said sheet material adjacent one another and seaming means operable to form said opposed side edges into a longitudinal seam and thereby provide a seamed tube.

2. A method for forming a seamed tube of arcuate section from sheet material comprising:

supporting said sheet material on a support adjacent a mandrel having a desired arcuate cross-section with the plane of said sheet tangential to the arc of said mandrel;

moving a symmetrical pair of elongated roller means whose axes lie parallel to the axis of the mandrel and which are biased towards each other on opposite sides of said support into engagement with an outside surface of said sheet material immediately adjacent said support and the line of tangency of said sheet to said arc and pressing said sheet material against said mandrel solely by means of said roller means from said line of tangency in a progressive and symmetric manner around said mandrel to at least a point adjacent a widest portion of said mandrel;

completing the forming of the sheet material around said mandrel by bringing opposed side edges of the sheet material adjacent each other; and forming said opposed side edges into a longitudinal seam to thereby provide a seamed tube.

* * * * *